US011874086B2

(12) United States Patent
Kincel et al.

(10) Patent No.: US 11,874,086 B2
(45) Date of Patent: Jan. 16, 2024

(54) FIREARM ACCESSORY MOUNTING ASSEMBLY

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 0 days.

(21) Appl. No.: 17/271,102

(22) PCT Filed: Aug. 26, 2019

(86) PCT No.: PCT/US2019/048145

§ 371 (c)(1),
(2) Date: Feb. 24, 2021

(87) PCT Pub. No.: WO2020/060723

PCT Pub. Date: Mar. 26, 2020

(65) Prior Publication Data

US 2021/0325144 A1 Oct. 21, 2021

Related U.S. Application Data

(60) Provisional application No. 62/722,565, filed on Aug. 24, 2018.

(51) Int. Cl.
*F41C 27/00* (2006.01)
*F41C 23/16* (2006.01)

(52) U.S. Cl.
CPC ..... *F41C 27/00* (2013.01); *F41C 23/16* (2013.01)

(58) Field of Classification Search
CPC ..... F41C 27/00; F41C 23/16
See application file for complete search history.

(56) References Cited

U.S. PATENT DOCUMENTS 3,066,375 A * 12/1962 Knowles ..... F41C 23/02 24/639
7,331,872 B1 * 2/2008 Parsons ..... A45F 5/02 224/195

(Continued)

OTHER PUBLICATIONS

International Search Report and Written Opinion for Application No. PCT/US2019/048145 dated May 6, 2020 (17 pages).

*Primary Examiner* — Michelle Clement
(74) *Attorney, Agent, or Firm* — MICHAEL BEST & FRIEDRICH LLP

(57) ABSTRACT

A firearm accessory mounting system includes a mount for attachment to a firearm mounting structure such as a handguard. The firearm mounting structure includes a slot. The mount includes projections around an opening for a fastener. The projections may, for example, be a slotted recoil lug. The opening includes first and second regions having different slopes. The fastener has a head which, during tightening, initially engages the second region to deform the projections radially outward against an end of the slot in the firearm mounting structure. Continued tightening of the fastener causes the head to engage the first region of the opening to apply an axial clamping force on the mount against the firearm mounting structure. This results in securing forces both transverse and parallel to the rotational axis of the fastener.

10 Claims, 6 Drawing Sheets

(56) References Cited

U.S. PATENT DOCUMENTS 8,925,236 B1 * 1/2015 Mayberry ..... F41G 11/004 42/124
9,459,078 B1 * 10/2016 Kincel ..... F41G 11/004
9,599,439 B1 * 3/2017 Sylvester ..... F41G 11/003
9,696,112 B2 * 7/2017 Gottzmann ..... F41G 11/003
9,766,035 B2 * 9/2017 Storch ..... F41C 23/16
9,964,380 B1 * 5/2018 Oglesby ..... F41C 23/16
10,036,602 B1 7/2018 Nuss et al.
10,209,032 B1 * 2/2019 Aguirre ..... F41C 33/0236
10,295,304 B1 * 5/2019 Kincel ..... F41G 11/003
10,539,387 B1 * 1/2020 Joplin ..... F41A 21/487
10,551,145 B2 * 2/2020 Kincel ..... F41C 23/16
10,775,129 B1 * 9/2020 Kincel ..... F41C 23/16
2004/0009034 A1 * 1/2004 Miller ..... F41G 11/003 403/363
2005/0169726 A1 8/2005 McClure
2012/0167434 A1 * 7/2012 Masters ..... F41G 11/003 42/90
2012/0279107 A1 * 11/2012 Hoel ..... F41G 11/003 42/90
2012/0305613 A1 * 12/2012 Allen ..... A47B 81/005 224/545
2013/0104441 A1 * 5/2013 Kincel ..... F41G 11/004 42/90
2013/0185895 A1 * 7/2013 Daniel ..... F16B 5/0258 16/2.1
2014/0130390 A1 5/2014 Geissele
2015/0007476 A1 1/2015 Dextraze
2015/0198408 A1 * 7/2015 Kincel ..... F41C 23/16 42/72
2015/0219422 A1 * 8/2015 Kincel ..... F41C 23/16 29/525.11
2015/0285583 A1 * 10/2015 Mayberry ..... F41A 23/08 42/71.01
2016/0010946 A1 1/2016 Gibbens et al.
2016/0061561 A1 * 3/2016 Challis ..... F41C 23/16 411/103
2016/0116252 A1 * 4/2016 Kincel ..... F41C 27/00 42/90
2016/0349011 A1 * 12/2016 Jen ..... F41G 11/001
2017/0059273 A1 3/2017 Geissele
2017/0248389 A1 * 8/2017 DiCarlo ..... F41G 11/007
2018/0100719 A1 * 4/2018 Moretti ..... F41C 23/22
2018/0112952 A1 * 4/2018 Kincel ..... F41C 27/00
2018/0195834 A1 * 7/2018 Tedder ..... B60R 7/14
2018/0216911 A1 * 8/2018 Jen ..... F41G 11/003
2018/0335273 A1 * 11/2018 Doty ..... F41C 23/14
2019/0085595 A1 * 3/2019 Ervin ..... E05B 37/16
2019/0113306 A1 * 4/2019 Kincel ..... F41C 23/16
2019/0277598 A1 * 9/2019 Kincel ..... F41C 23/16
2020/0011636 A1 * 1/2020 Jen ..... F41C 33/007
2020/0208946 A1 * 7/2020 Cahill ..... F41G 11/001
2021/0325144 A1 * 10/2021 Kincel ..... F41C 23/16
2021/0372736 A1 * 12/2021 Zhou ..... F21V 21/0885

* cited by examiner

FIREARM ACCESSORY MOUNTING ASSEMBLY

BACKGROUND

The present disclosure relates to mounting assemblies for firearm accessories.

When a firearm is discharged, accessories mounted to the firearm are subject to large acceleration impulses due to recoil. Over time, this can cause the accessories to loosen, shift, and in some cases, fall off. Shifting and loosening is particularly problematic with precision accessories, such as optics and aiming devices. Accordingly, a need exists for a firearm accessory mounting assembly able to better resist recoil.

SUMMARY

The present disclosure provides, in one aspect, a mounting assembly for coupling a firearm accessory to a firearm, the mounting assembly comprising: a mount including a first side coupled to the firearm accessory, a second side opposite the first side, an opening extending between the first and second sides, and a slit extending between the first and second sides and intersecting the opening, the slit dividing the mount into a first portion and a second portion, wherein the first portion and the second portion are on opposite sides of the slit; and a fastener extending through the opening, wherein the fastener is rotatable in a tightening direction to couple the mount to the firearm with the second side of the mount adjacent the firearm, and wherein the slit is configured to permit flexure of the first and second portions of the mount toward the firearm when the fastener is rotated in the tightening direction.

In one aspect, the invention further comprises a raised rib extending from the second side of the mount, the raised rib engageable with the firearm to define a gap between the firearm and the first and second portions of each mount, wherein the first and second portions are configured to flex into the gap when the fastener is rotated in the tightening direction. In one aspect of the invention, the firearm includes a rail with a plurality of elongated slots, and each fastener is insertable through a corresponding one of the plurality of elongated slots to couple the mount to the firearm. In one aspect of the invention, each of the elongated slots includes a first end and a second end opposite the first end, and each mount further includes a projection extending from the second side of the mount, the projection configured as a recoil lug engaging the first end or the second end of the corresponding elongated slot to inhibit movement of the firearm accessory. In one aspect of the invention, the slit is a first slit, and each mount further includes a second slit intersecting the opening. In one aspect of the invention, the first slit and the second slit are perpendicular to each other. In one aspect of the invention, the opening includes a tapered portion having a cross-sectional area that decreases in a direction from the first side toward the second side. In one aspect of the invention, the tapered portion includes a first region having a first slope and a second region having a second slope different than the first slope. In one aspect of the invention, the second slope is steeper than the first slope. In one aspect of the invention, the first region is closer to the first side of the mount, and the second region is closer to the second side of the mount.

The present disclosure provides, in another aspect, a method for coupling an accessory mount to a firearm, the method comprising: inserting a deflectable portion of the accessory mount and a fastener through a slot of the firearm, the fastener having a head and a rotational axis and extending through the accessory mount; tightening the fastener to deflect the deflectable portion with the head of the fastener transverse to the rotational axis; and after tightening the fastener, clamping with the head of the fastener the accessory mount against the firearm with a longitudinally-directed clamping force.

In one aspect of the invention, the inserting step includes abutting a rib of the accessory mount against the firearm to define a gap between the firearm and the deflectable portion, and tightening includes deflecting the deflectable portion into the gap. In one aspect of the invention, inserting includes extending the fastener through an opening in the accessory mount, the opening including a first region having a first slope and a second region having a second slope different than the first slope; tightening includes engaging the second region with the fastener head without engaging the first region; and clamping includes engaging the first region with the fastener head. In one aspect of the invention, inserting includes positioning a recoil lug of the accessory mount in the slot, the recoil lug including at least part of the deflectable portion.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
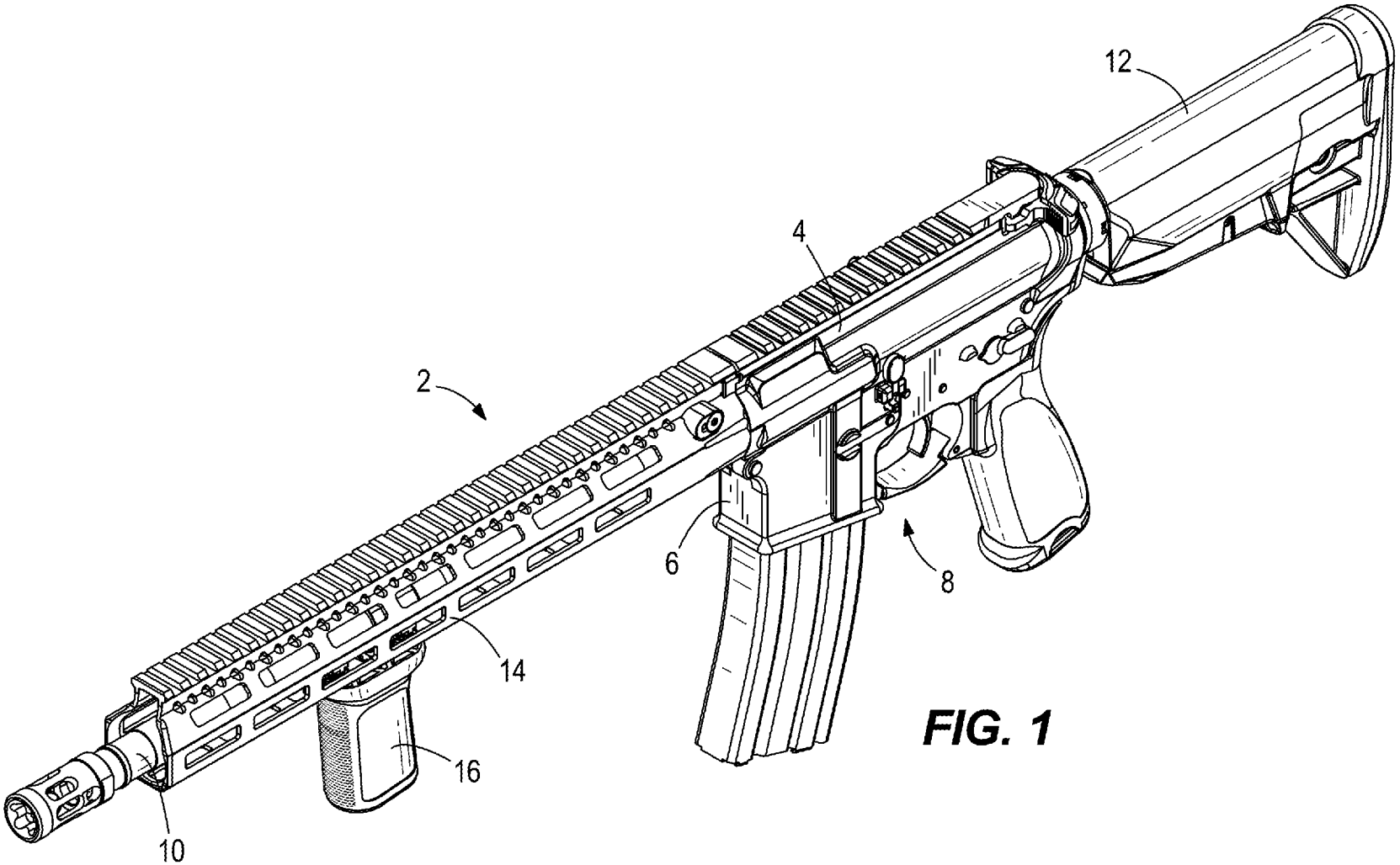
FIG. 1 is a side view of an exemplary firearm to which an accessory can be attached.

With reference to FIG. 1, a firearm 2 includes an upper receiver 4, a lower receiver 6 that cooperates with the upper receiver 4 to define a main body 8 of the firearm 2, and a barrel 10 extending from the upper receiver 4. A stock 12 is coupled to the main body 8 opposite the barrel 10, and a handguard 14 surrounds a portion of the barrel 10 adjacent the upper receiver 4. The illustrated firearm 2 also includes an accessory 16 (e.g., a flashlight, scope, sight, handgrip, sling, Picatinny adapter etc.) removably coupled to the handguard 14. In some embodiments, one or more accessories may be removably coupled to other parts of the firearm 2, such as the upper receiver 4.

Figure 2:
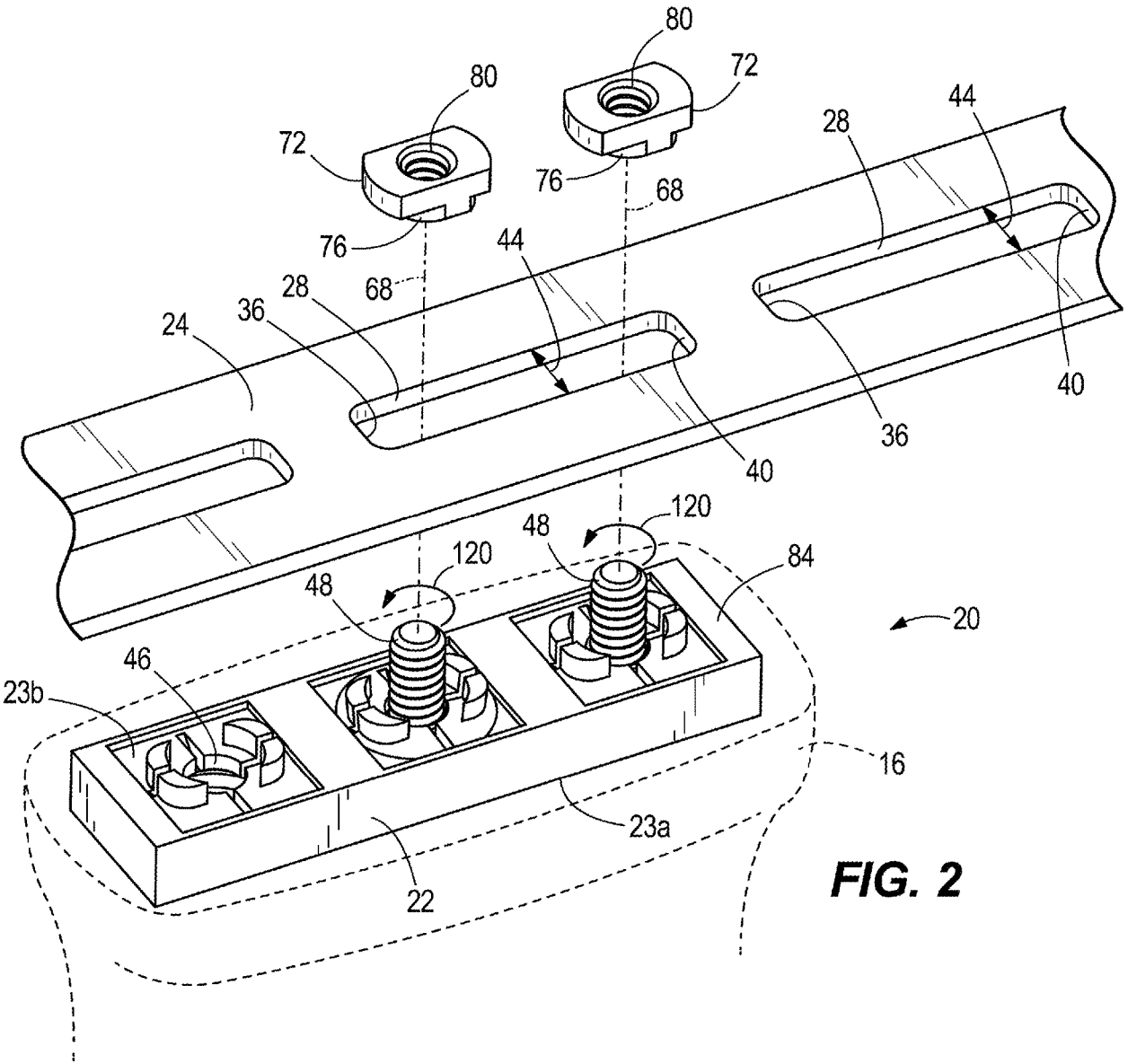
FIG. 2 is an exploded perspective view of a mounting assembly embodying aspects of the present disclosure.

FIG. 2 illustrates a mounting assembly 20, according to one embodiment, for coupling an accessory (e.g., the accessory 16) to a firearm (e.g., the firearm 2). The mounting assembly 20 includes a mount 22 (also called an accessory mount) removably coupled to a rail 24. The mount 22 has a first side 23*a* coupled to the accessory 16 and a second side 23*b* that interfaces with the rail 24. In some embodiments, the mount 22 may be an integral part of the accessory 16, and the rail 24 may be an integral part of the handguard 14 (FIG. 1). Alternatively, the rail 24 can be integrated into other parts of the firearm 2 (e.g., the upper receiver 4), or the rail 24 can be a separate part attached to the firearm 2 in any number of ways. For the sake of clarity, the accessory 16 is illustrated schematically in FIG. 2, and the rail 24 is illustrated without any surrounding parts of the firearm 2.

In the illustrated embodiment, the mounting assembly 20 is compatible with the M-LOK (by Magpul) accessory mounting interface, which is described in U.S. Pat. No. 8,925,236 to Mayberry et al., the entire content of which is hereby incorporated by reference. As such, the rail 24 includes a plurality of elongated slots 28, each with first and second opposite ends 36, 40. The slots 28 define a generally constant width 44 between the first and second ends 36, 40. In other embodiments, the rail 24 may include slots 28 of other shapes and arrangements (e.g., defining a KEYMOD accessory mounting interface, or any other interface suitable for mounting accessories).

Figure 3:
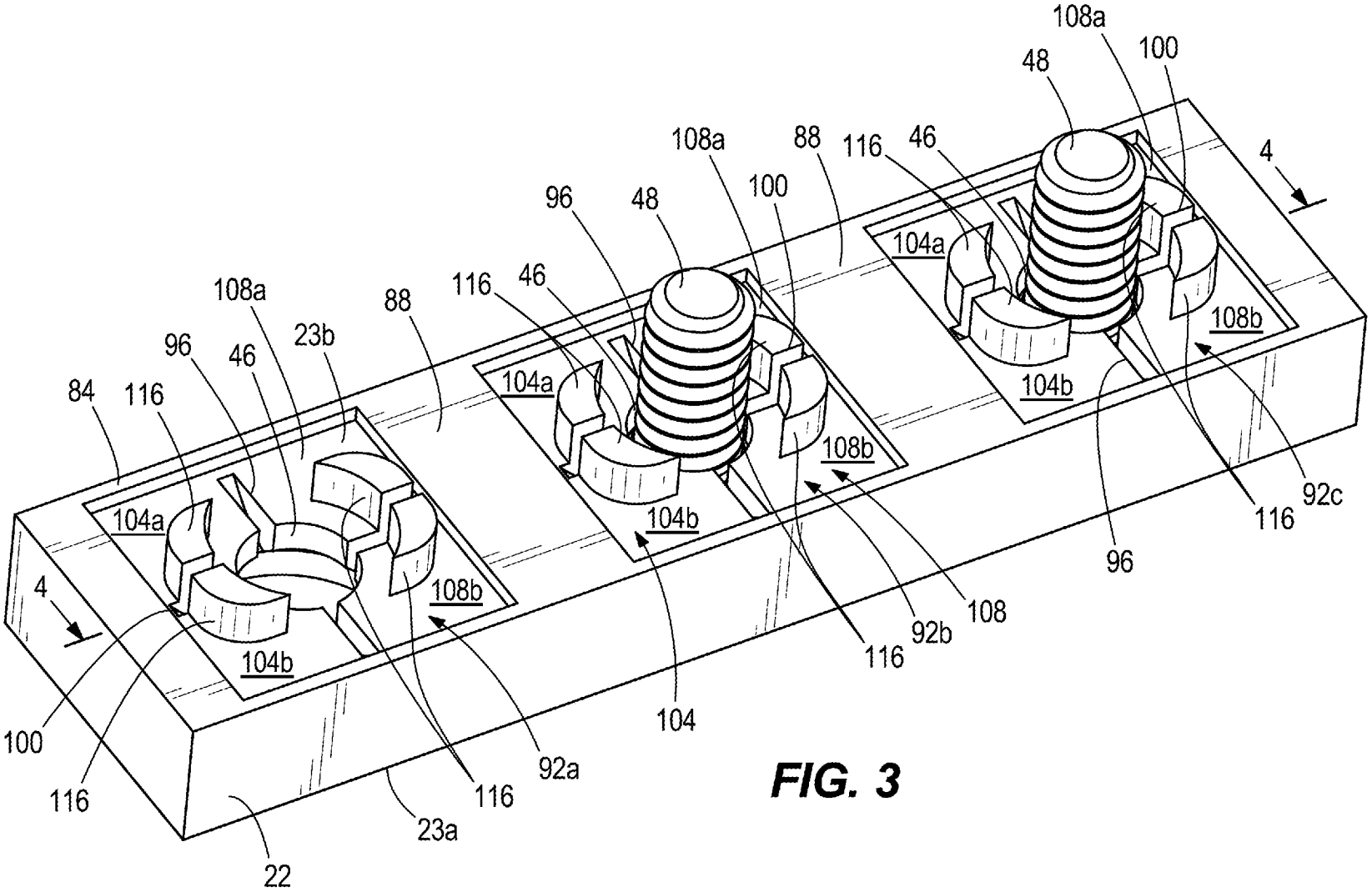
FIG. 3 is an enlarged perspective view of a mount of the mounting assembly of FIG. 2.

Referring to FIG. 3, the mount 22 includes a plurality of holes or openings 46 extending between the first and second sides 23*a*, 23*b*. Each of the openings 46 may receive a fastener 48 (e.g., a threaded bolt), such that the fastener 48 extends through the opening 46. In the illustrated embodiment, the mount 22 includes three openings 46, and the mounting assembly 20 includes two fasteners 48. However, the mount 22 may include any number of openings 46, and any number of fasteners 48 may be distributed amongst the openings 46 in any manner suitable for coupling the mount 22 to the rail 24.

Figure 5:
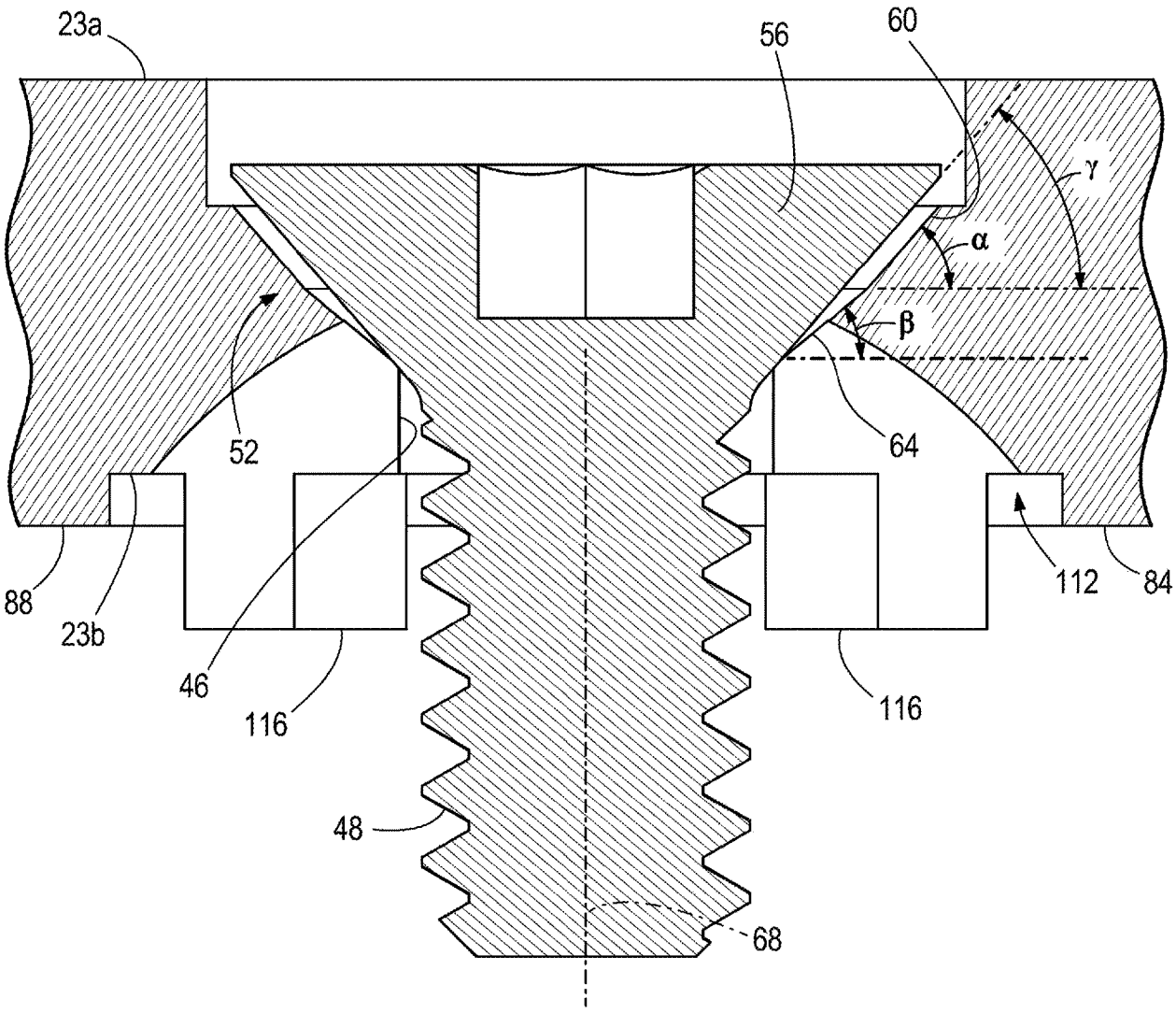
FIG. 5 is a cross-sectional view illustrating a portion of the mount of FIG. 3 in a loosened state.

With reference to FIG. 5, each opening 46 includes a tapered portion 52 having a cross-sectional area that decreases in a direction from the first side 23*a* toward the second side 23*b*. Each of the fasteners 48 includes a countersunk head 56 that is received within the tapered portion 52 and a threaded shaft extending along a rotational axis 68 which is also the longitudinal axis of the fastener 48. In the illustrated embodiment, the tapered portion 52 includes a first region 60 having a first slope $\alpha$ and a second region 64 having a second slope $\beta$. The first slope $\alpha$ and the second slope $\beta$ are defined as the included angles between the wall defining the opening 46 in the first region 60 and the second region 64, respectively, and a plane that is transverse (i.e., perpendicular) to the rotational axis 68 of the fastener 48. The second slope $\beta$ is steeper with respect to the transverse plane than the first slope $\alpha$ (i.e., $\alpha>\beta$). The tapered head 56 has a smooth conical surface defining a head angle $\gamma$ with respect to the transverse plane. The first slope $\alpha$ is about equal to the head angle $\gamma$.

With reference to FIG. 2, each of the fasteners 48 is threadably coupled to a corresponding nut 72. The illustrated nuts 72 are generally T-shaped and include a stem portion 76 and a flange portion 80. In the illustrated embodiment, the flange portions 80 are sized such that each nut 72 is insertable into the slot 28 when the nut 72 is in a first or unlocked orientation (e.g., the orientation illustrated in FIG. 2), but cannot be inserted or removed from the slot 28 when in a second or locked orientation (e.g., rotated 90 degrees from the orientation illustrated in FIG. 2).

Referring to FIG. 3, the mount 22 includes a raised rib 84 extending from the second side 23*b*. In particular, the rib 84 extends along the perimeter of the second side 23*b* of the mount 22 and has two cross-members 88 that span across the mount 22. The cross-members 88 thus divide the mount 22 into sections 92*a*, 92*b*, 92*c*, each section 92*a*, 92*b*, 92*c* containing one of the openings 46. In the illustrated embodiment, each section 92*a*, 92*b*, 92*c* of the mount 22 includes a first slit 96 and a second slit 100 that intersect the opening 46. The slits 96, 100 extend between the first and second sides 23*a*, 23*b* of the mount 22. The first slit 96 divides each section 92*a*, 92*b*, 92*c* into a first portion 104 and a second portion 108, such that the first portion 104 and the second portion 108 are on opposite sides of the first slit 96. The second slit 100 divides each of the first and second portions 104, 108 into first and second sub-portions 104*a*, 104*b*, 108*a*, 108*b*, respectively. In the illustrated embodiment, the first slit 96 and the second slit 100 are perpendicular to each other and the intersection of the slits 96, 100 is centered on the opening 46. In other constructions, the first slit 96 and the second slit 100 can intersect at other angles and/or the intersection can be off-center as desired for a particular application. Alternatively, each section 92*a*, 92*b*, 92*c* may include three or more slits, or one or both of the first and second slits 96, 100 may be omitted.

Figure 6:
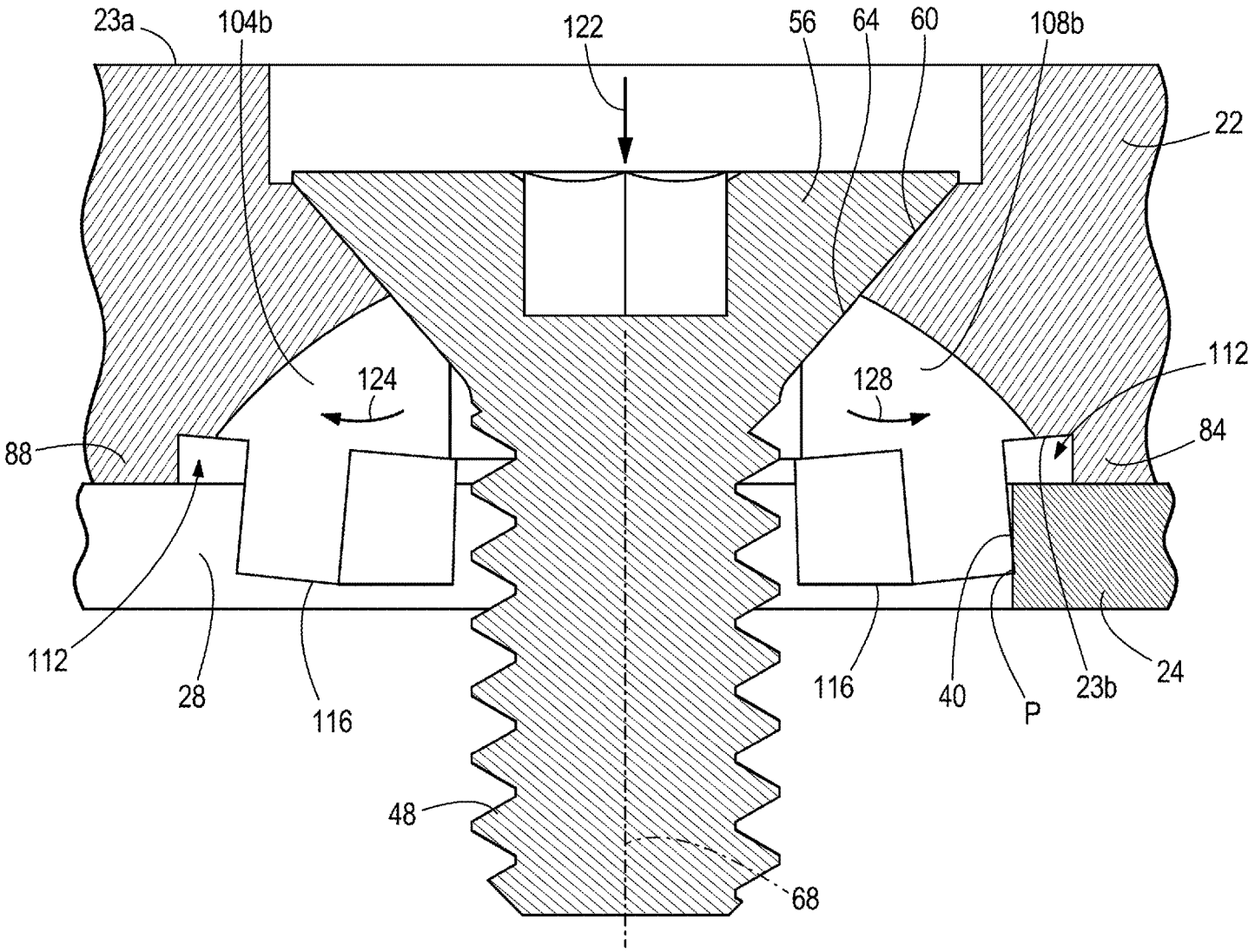
FIG. 6 is a cross-sectional view illustrating the portion of the mount of FIG. 3 in a tightened state.

The raised rib 84 is engageable with the rail 24 to define a relief or gap 112 (FIG. 6) between the rail 24 and the first and second portions 104, 108 of each section 92*a*, 92*b*, 92*c*. In other words, the bottom side 23*b* of the mount 22 is spaced from the rail 24 by the gap 112. The mount 22 further includes a plurality of projections 116 that extend from the second side 23*b* (FIG. 3). The projections 116 form split recoil lugs that at least partially surround each of the openings 46 and fasteners 48. The projections 116 are engageable with the rail 24 at the ends 36, 40 of the slots 28 to transmit at least a portion of recoil forces that occur when firing the firearm 2 directly to the mount 22 (rather than through the fasteners 48). The sub-portions 104*a*, 104*b*, 108*a*, 108*b* and the projections 116 may collectively be referred to as "deflectable portions" of the accessory mount because the slits 96, 100 and gaps 112 permit them to deflect during assembly as will be discussed below. In their undeflected, at-rest state, the projections 116 fit within the ends 36, 40 of the slots 28 in light contact or with a small degree of play.

In operation, an operator uses the firearm accessory mounting system 20 to couple the mount 22 to the rail 24 (and thus, the accessory 16 to the firearm 2). More broadly speaking, this may be characterized as a method for coupling the accessory mount 22 to the firearm 2 because the invention is not limited to a handguard or rail 24 as illustrated. The operator first extends the fasteners 48 through the openings 46 of the accessory mount 22 from the first side 23*a* with the head 56 received in the taped opening 46. The operator then threads the nuts 72 onto the free end of the fasteners 48. Then the operator aligns the flange portions 80 of the nuts 72 with the elongated slots 28 in the rail 24 (FIG. 2).

Next, the operator moves the mount 22 toward the rail 24 to insert the nuts 72, projections 116, and fasteners 48 into and/or through one of the slots 28. It has been noted that the projections 116 may be referred to as deflectable portions, so this step may also be characterized as inserting a deflectable portion of the accessory mount 22 and a fastener 48 through a slot 28 of the firearm 2. This inserting step also includes abutting the ribs 84, 88 of the accessory mount 22 against the rail 24 or firearm 2 to define the gap 112 between the rail 24 or firearm 2 and the deflectable portions. As noted above, the projections 116 fit within the ends 36, 40 of the slots 28 in light contact or with a small degree of play.

The operator then rotates each fastener 48 (using a fastener driver such as a screwdriver or hex key in some embodiments) about its respective rotational axis 68 in a tightening direction 120. As the fastener 48 rotates in the tightening direction 120 with respect to the accessory mount 22, the fastener 48 advances along the rotational axis 68. In the first ninety degrees of rotation in the tightening direction 120, the nut 72 co-rotates with the fastener 48 to the locked position, which prevents the nut 72 from being withdrawn from the slot 28. Upon reaching the locked position, the nut 72 is prevented from further rotation by engagement of a locking surface (not shown) on the nut 72 with the rail 24 and/or the mount 22. Further rotation of the fastener 48 in the tightening direction 120 then draws the nut 72 toward the mount 22 and moves the head 56 deeper into the opening 46, thereby clamping the rail 24 between the flange portion 80 of each nut 72 and the bottom side 23*b* of the mount 22.

Figure 4:
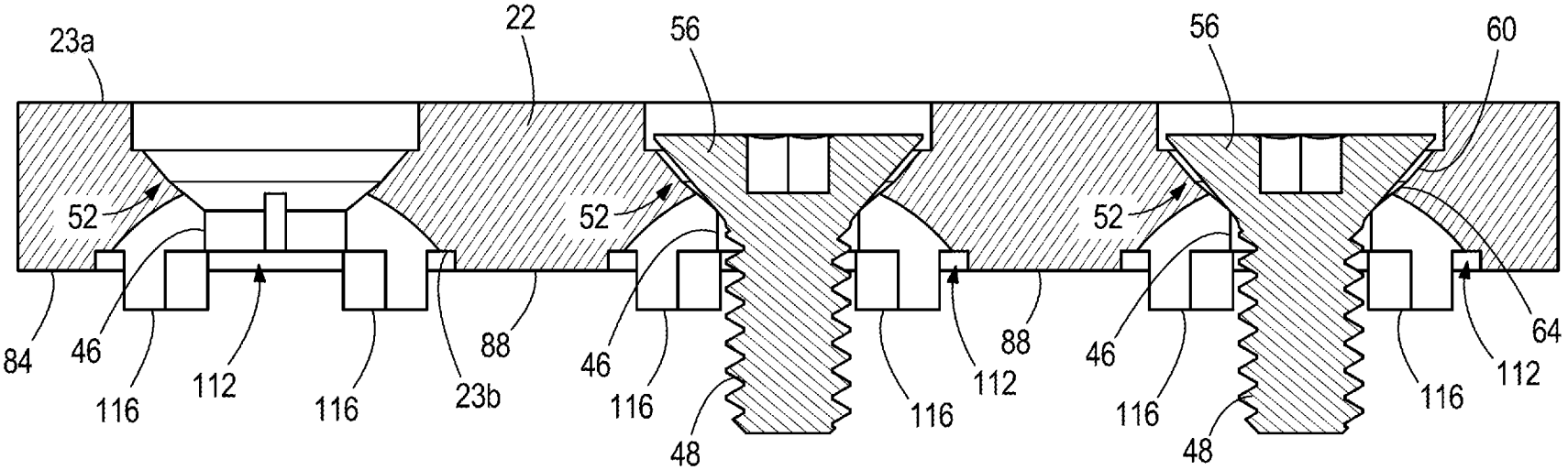
FIG. 4 is a side view of the mount of FIG. 3.

As each fastener 48 is initially tightened, the countersunk head 56 engages the periphery of the opening 46 in the second region 64 (FIG. 4) because the relatively steep slope β causes the second region 64 to extend into the path of the head 56. The head 56 preferably engages the second region 64 without also engaging the first region 60. The slits 96, 100 (FIG. 3) allow the mount 22 to flex around the opening 46. Accordingly, the force exerted by the countersunk head 56 of the fastener 48 resiliently pivots, deflects or deforms the sub-portions 104*a*, 104*b*, 108*a*, 108*b* of the mount 22 into the gap 112 (FIG. 6) and consequently moves the projections 116 outwardly. The relatively steep slope β in the second region 64 accelerates this deformation during initial tightening of the fastener 48. The projections 116 include distal ends that define a point P of engagement between the projections 116 and the slot 28 at ends 36, 40 of the slot 28 and the sidewalls of the slot 28 immediately adjacent the ends 36, 40. This engagement of the slot 28 with the projections 116 centers the accessory mount 22 in the slot 28. Thus, the operator tightens the fastener 48 through an initial tightening portion to deflect the deflectable portions (i.e., the sub-portions 104*a*, 104*b*, 108*a*, 108*b* and the projections 116) with the head 56 of the fastener 48 transverse to the rotational axis 68 to center the accessory mount 22 in the slot 28.

As the fastener 48 continues to be tightened (translating or advancing the fastener 48 into the mount 22 in the direction of arrow 122), the countersunk head 56 also comes into engagement with the periphery of the opening 46 in the first region 60. The relatively shallow slope α in the first region 60 allows the fastener 48 to develop a greater axial clamping force to secure the mount 22 to the rail 24 between the head 56 of the fastener 48 and the nut 72. The flexure of the mount 22 pushes the deflectable portions (i.e., the sub-portions 104*a*, 104*b*, 108*a*, 108*b* and the projections 116) both outwardly and toward the rail 24, generally in the directions of arrows 124 and 128. This results in a more positive engagement of the slots 28 with the projections 116 to facilitate the recoil resistance or absorption function of the projections 116. To summarize, after the initial tightening portion the operator clamps, with the head 56 of the fastener 48, the centered accessory mount 22 against the firearm 2 with a longitudinally-directed clamping force.

In other embodiments, the projections 116 may be longer such that they extend fully through the slot 28 with a distal end of the projections 116 below the rail 24. In such other embodiments, the deformation of the sub-portions 104*a*, 104*b*, 108*a*, 108*b* may results in the projections 116 expanding not only into engagement with the ends 36, 40 of the slot 28, but also underneath the ends 36, 40. In such embodiments, the point P of engagement would be between the sides of the projections 116 (as opposed to the distal ends of the projections 116) and the underside of the rail 24 (i.e. the side of the rail 24 opposite the mount 22). In such embodiments, the projections 116 would both center the accessory mount 22 in the slot 28 and further resist forces parallel to the rotational axes 68 of the fasteners 48.

Although the disclosure has been described in detail with reference to certain preferred embodiments, variations and modifications exist within the scope and spirit of one or more independent aspects of the disclosure as described.

Various features of the invention are set forth in the following claims:

What is claimed is:

1. A mounting assembly for coupling a firearm accessory to a firearm, the mounting assembly comprising:
- a mount including
  - a first side coupled to the firearm accessory,
  - a second side opposite the first side,
  - an opening extending between the first and second sides, and
  - a slit extending between the first and second sides and intersecting the opening, the slit dividing the mount into a first portion and a second portion, wherein the first portion and the second portion are on opposite sides of the slit; and
- a fastener extending through the opening,
- wherein the fastener is rotatable in a tightening direction to couple the mount to the firearm with the second side of the mount adjacent the firearm, and
- wherein rotation of the fastener in the tightening direction causes the first and second portions of the mount to flex toward the firearm.

2. A mounting assembly for coupling a firearm accessory to a firearm, the mounting assembly comprising:
- a mount including
  - a first side coupled to the firearm accessory,
  - a second side opposite the first side,
  - a first portion,
  - a second portion,
  - an opening between the first portion and the second portion, the opening extending through the first and second sides, and
  - a raised rib extending from the second side of the mount, the raised rib engageable with the firearm to define a gap between the firearm and the first and second portions of the mount; and
- a fastener extending through the opening, wherein the fastener is rotatable in a tightening direction to couple the mount to the firearm with the second side of the mount adjacent the firearm, and
- wherein the first and second portions are configured to flex into the gap when the fastener is rotated in the tightening direction.

3. The mounting assembly of claim 1,
- wherein the firearm includes a rail with a plurality of elongated slots, and
- wherein each fastener is insertable through a corresponding one of the plurality of elongated slots to couple the mount to the firearm.

4. The mounting assembly of claim 1,
- wherein each of the elongated slots includes a first end and a second end opposite the first end, and
- wherein each mount further includes a projection extending from the second side of the mount, the projection configured as a recoil lug engaging the first end or the second end of the corresponding elongated slot to inhibit movement of the firearm accessory.

5. The mounting assembly of claim 1, wherein the slit is a first slit, and wherein each mount further includes a second slit intersecting the opening.

6. The mounting assembly of claim 5, wherein the first slit and the second slit are perpendicular to each other.

7. A mounting assembly for coupling a firearm accessory to a firearm, the mounting assembly comprising:

a mount including a first side coupled to the firearm accessory, a second side opposite the first side, an opening extending between the first and second sides, and a slit extending between the first and second sides and intersecting the opening, the slit dividing the mount into a first portion and a second portion, wherein the first portion and the second portion are on opposite sides of the slit; and a fastener extending through the opening, wherein the fastener is rotatable in a tightening direction to couple the mount to the firearm with the second side of the mount adjacent the firearm, wherein the slit is configured to permit flexure of the first and second portions of the mount toward the firearm when the fastener is rotated in the tightening direction, and wherein the opening includes a tapered portion having a cross-sectional area that decreases in a direction from the first side toward the second side.

8. The mounting assembly of claim 7, wherein the tapered portion includes a first region having a first slope and a second region having a second slope different than the first slope.

9. The mounting assembly of claim 8, wherein the second slope is steeper than the first slope.

10. The mounting assembly of claim 9, wherein the first region is closer to the first side of the mount, and the second region is closer to the second side of the mount.

* * * * *